United States Patent [19]

Anderson

[11] 4,446,945

[45] May 8, 1984

[54] BRACE FOR SECURING A POLE TO SUPPORT SURFACE

[76] Inventor: Carl Anderson, 12 St. Stephens Pl., Staten Island, N.Y. 10306

[21] Appl. No.: 339,091

[22] Filed: Jan. 13, 1982

Related U.S. Application Data

[63] Continuation-in-part of Ser. No. 255,631, Apr. 20, 1981, which is a continuation-in-part of Ser. No. 143,506, Apr. 24, 1980.

[51] Int. Cl.[3] ..... E04G 5/04

[52] U.S. Cl. ..... 182/229; 182/214; 248/245; 248/284

[58] Field of Search ..... 182/229, 214, 93, 45, 182/82; 248/284, 293, 240.4, 245

[56] References Cited

U.S. PATENT DOCUMENTS

| | | | |
|---|---|---|---|
| 2,185,948 | 1/1940 | Pimm | 182/229 |
| 2,392,932 | 1/1946 | Macbeth | 403/73 |
| 2,418,968 | 4/1947 | Crouch | 248/240.4 |
| 2,599,169 | 6/1952 | Finney | 182/214 |
| 2,680,554 | 6/1954 | Dakin | 182/214 |
| 2,993,562 | 7/1961 | Hussey | 182/229 |
| 3,098,540 | 7/1963 | Hines | 182/229 |
| 4,164,269 | 8/1979 | Jackson | 182/229 |

*Primary Examiner*—Reinaldo P. Machado
*Assistant Examiner*—Alvin Chin-Shue

[57] ABSTRACT

A brace for securing a pole to a support surface. The brace includes a frame member which is securely connected to the support surface. A yoke assembly is provided for retaining the pole. A swivel mechanism couples the yoke assembly and the frame member and permits modification of the relative vertical orientation of the pole with respect to the support surface. The swivel means permits relative rotation about two mutually perpendicular horizontal axes.

10 Claims, 6 Drawing Figures

BRACE FOR SECURING A POLE TO SUPPORT SURFACE

RELATIONSHIP TO OTHER APPLICATIONS

This invention is a continuation-in-part application of Ser. No. 255,631 filed on Apr. 20, 1981, which in turn is a continuation-in-part application of Ser. No. 143,506 filed on Apr. 24, 1980, the entire disclosure of both prior applications is hereinincorporated by reference.

BACKGROUND OF THE INVENTION

This invention relates to a brace, and more particularly to a device which secures a pump jack pole to a support surface such as a wall or roof.

In utilizing scaffolding equipment for installation of aluminum sliding, and the like, there is typically utilized a series of upright poles which support horizontal planks on which the workers stand. The poles are secured to a wall or roof of the housing structure. For such securing purposes there is usually provided at least one or two braces which hold the pole and secure onto the support surface.

The pole is then retained in place by means of a clamp which abuts against the pole and locks it in the brace. A particularly unique and beneficial type of clamping device used for this purpose is described in the aforementioned Ser. No. 255,631.

The typical brace heretofore utilized includes a V-shaped frame with the two legs being pivoted with respect to each other. The distal ends of the V-shaped frame are connected to a support surface. One of the legs usually extends from the support surface and is bent. Two side plates are spaced on this bent portion and are to be placed on either side of the pole. The clamping device then closes the side plates.

One problem of such prior art braces concerns the pivotal movement between the two legs of the brace. Because of such pivoting there is a chance that the legs may swing with respect to each other during attachment. Another problem is that when the pole must be vertically oriented in order to install it or to pass a pump jack above the brace connection, the brace may become twisted and may bend out of shape or even crack. Furthermore, the connection of the two legs to the support surface is limited and it becomes difficult to properly place the two legs in symmetrical orientation on the support surface because each one is separately secured.

Numerous other difficulties are encountered when utilizing the prior art brace. As a result, not only has this brace caused operational and installational difficulties, but even safety problems are caused by utilization of such prior art braces. As a result, a new brace arrangement is needed for securing an upright pole to the support surface.

SUMMARY OF THE INVENTION

Accordingly, it is an object of the present invention to provide an improved brace which avoids the aforementioned problems of prior art devices.

Another object of the present invention is to provide a brace especially for use in connection with clamping poles, and specifically pump jack poles, to a support surface.

Still another object of the present invention is to provide a brace which can securely retain an upright post in position spaced from a support surface.

A further object of the present invention is to provide a brace which permits changing of the vertical orientation of a pole secured therein with respect to a support surface.

Still a further object of the present invention is to provide a brace which securely retains an upright post spaced from a support surface and permits modification of the relative vertical orientation of the pole with respect to the support surface and two mutually perpendicular horizontal axes.

Briefly, in accordance with the present invention, there is provided a brace for securing a pole to a support surface. The brace includes a frame member which can be secured to the support surface and a yoke assembly for retaining the pole. A swivel mechanism is provided for coupling the yoke assembly with the frame member. The swivel mechanism permits modification of the relative vertical orientation of the pole with respect to the support surface. Such vertical orientation can be changed about two mutually perpendicular horizontal axes In an embodiment of the invention, the yoke assembly includes a pair of U-shaped yoke members each having a respective pair of legs interconnected by a respective bight portion. One of the yoke members is coupled to the frame member while the other of the yoke members fits around the pole. The swivel mechanism includes a pivot member which couples the yoke members at their respective bight portions.

In an embodiment of the invention, the frame member comprises an X-shaped rod structure having a connecting rod closing off one end thereof. The connecting rod pivotally passes through the opposing legs of one of the yoke members.

The aforedescribed features and advantages of the invention will, in part, be pointed out with particularity and will, in part, become obvious from the following more detailed description of the invention, taken in conjunction with the accompanying drawings which form an integral part thereof.

BRIEF DESCRIPTION OF THE DRAWINGS

In the drawings.

In the various figures of the drawing, like reference characters designate like parts.

DESCRIPTION OF THE PREFERRED EMBODIMENTS

Figure 1:
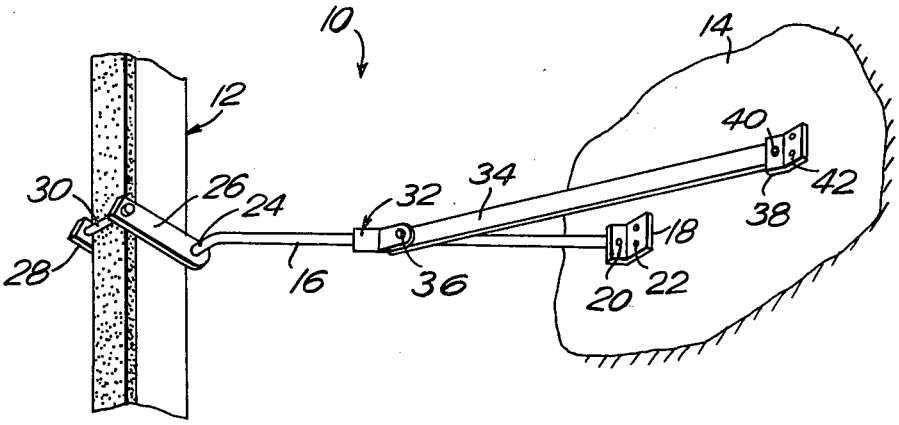
(PRIOR ART) FIG. 1
FIG. 1 is a perspective view showing utilization of a prior art brace holding an upright pole with respect to a support surface.

Referring now to FIG. 1, there is shown a perspective view of a prior art brace 10 which serves to hold an upright pole 12 securely spaced from a support surface 14. The brace comprises one rod like leg 16 having one end connected to a bracket 18 by means of the pivot pin 20. The bracket 18 is secured onto the support surface by means of fastening members 22 such as screws, nails or the like. The other end of the rod 16 is bent at 24 so as to form the back portion of a yoke comprising the side straps 26, 28. The side straps 26, 28 fit on the two sides of the pole 12 and hold the pole. The pole is secured in place by means of a clamp 30, typically a bolt which is held in place by means of a wing nut.

Coupled to the mid section of the rod 16 is a sleeve 32 which is connected to the arm 34 by means of the fastening member 36. The arm 34 also supports a bracket 38 at the distal end thereof by means of the pivot pin 40. The bracket 38 is also fastened to the support surface by means of the fastening members 42.

The arm 34 can pivot with respect to the rod 16 by means of the sleeve 32. Furthermore, the brackets 20, 38 can pivot with respect to the rod 16 and arm 34.

The particular brace used in the prior art has provided numerous difficulties in operation as well as assembly. For example, because of the pivoting of the arm 34 with respect to the rod 16, it becomes difficult to connect the brace to a support surface. After connecting the rod, the arm may tend to swing thereby providing difficulties in connection to the support surface. Furthermore, since the brackets 20 and 38 are separate, after attaching one bracket to the support surface, it is not always possible to connect the other bracket on the same horizontal plane. As a result, one bracket may be twisted, causing stress onto the brace which may cause fracture or bending of the brace.

Additional problems concern the connection of the straps to the pole. The straps themselves tend to slide along the bent rod portion 24 and often do not snugly fit on the sides of the pole. Furthermore, since the pole rests against the rod itself, there is provided insufficient support at the rear portion. The rod itself may bend to twist or bend thereby modifying suitable alignment of the vertical pole and preventing proper vertical orientation of the pole.

Additional problems concern utilization of the brace in connection with the pole itself. Typically, when the pole is a pump jack pole, a pump jack rides up and down the pole. When the pump jack reaches the brace, it is necessary to bypass the brace in order to raise the pump jack above the level of the brace. In doing so, the brace is disconnected from the pole. During such disconnection, the brace must be moved out to be of the way. Such movement may sometimes twist the brace. Also, the sway of the pole causes stress on the brace since it cannot twist or bend.

Other problems in connection with the prior art brace concern placement of the brace on support surfaces. When supports are vetical, the brace may be suitably connected to such support surface. However, in such sloped roofs as are found in typical Cape Cod housing construction, the roofs are angled and suitable connection of the brace to the support surface becomes awkward, difficult, and sometimes impossible.

Figure 2:
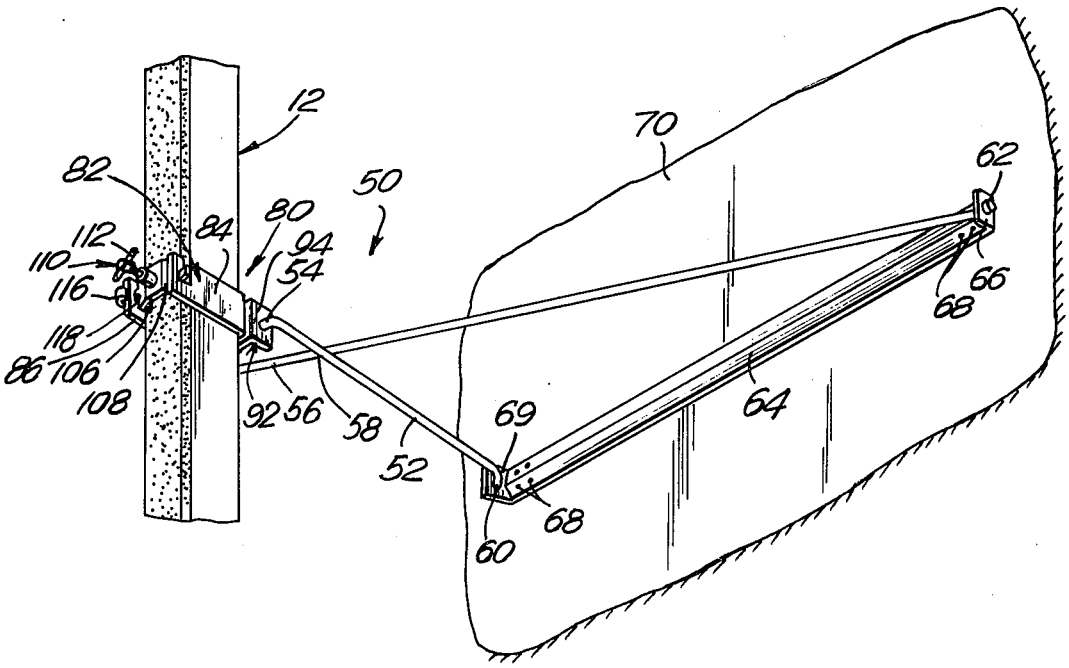
FIG. 2 is a perspective view similar to that shown in FIG. 1 and showing the brace of the present invention.

Referring now to FIG. 2, there will be shown the improved brace in accordance with the present invention. The brace is shown generally at 50 and includes a rod frame formed into an x-shaped configuration. Specifically, a first rod 52 extends from a support surface until it reaches a bend 54 and then extends perpendicular to the support surface until it reaches another bend and continues into the rod 56 back to the support surface. The two rods form an X-shaped configuration crossing each other at the point 58. It should be noted that the rod frame is formed of one piece construction.

At the distal ends of the rods there are provided out-turned feet. Specifically, rod 52 terminates in the outwardly extending foot portion 60, and similarly rods 56 terminate in its outwardly turned foot portion 62.

Interconnecting the foot portions there is provided a connecting bar 64 which spans across the ends of the X-shaped frame structure.

At opposing ends of the connecting bar 64 there are provided upwardly turned tab portions 66, 69 with apertures therein for respectively receiving the outwardly turned feet 60, 62 so as to provide pivotal interconnection between the X-shaped frame construction 50 and the connecting bar 64. Fastening holes 68 are provided adjacent the distal ends of the connecting bar.

Figure 5:
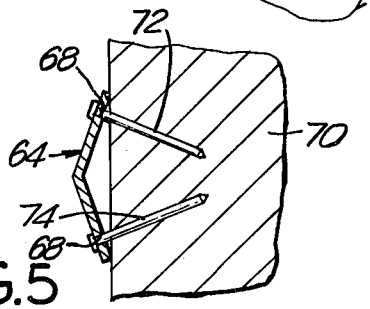
FIG. 5 is a cross sectional view taken along lines 5—5 of FIG. 4.

As can best be seen in FIG. 5, the connecting bar 64 has a substantially V-shaped configuration bowing outwardly from the support surface 70 to which it is attached. This outwardly bowed construction provides support and rigidity for such bar. Additionally, because of the outward bowing, the apertures 68 formed for receiving the fastening means will be angled with respect to the support surface 70. As a result, nails 72 or other similar fastening members, passing through the aperture 64 will be angled with respect to the support surface 70.

More specifically, those nails 73 passing through the upper part of the connecting bar will be angled downwardly while the nails 74 passing through the bottom part of the connecting bar will be angled upwardly. This angled insertion of the nails provides additional gripping of the nails to the support surface so as to prevent pulling out of the connecting bar from the support surface. This adds additional rigidity and support for the brace.

Figure 3:
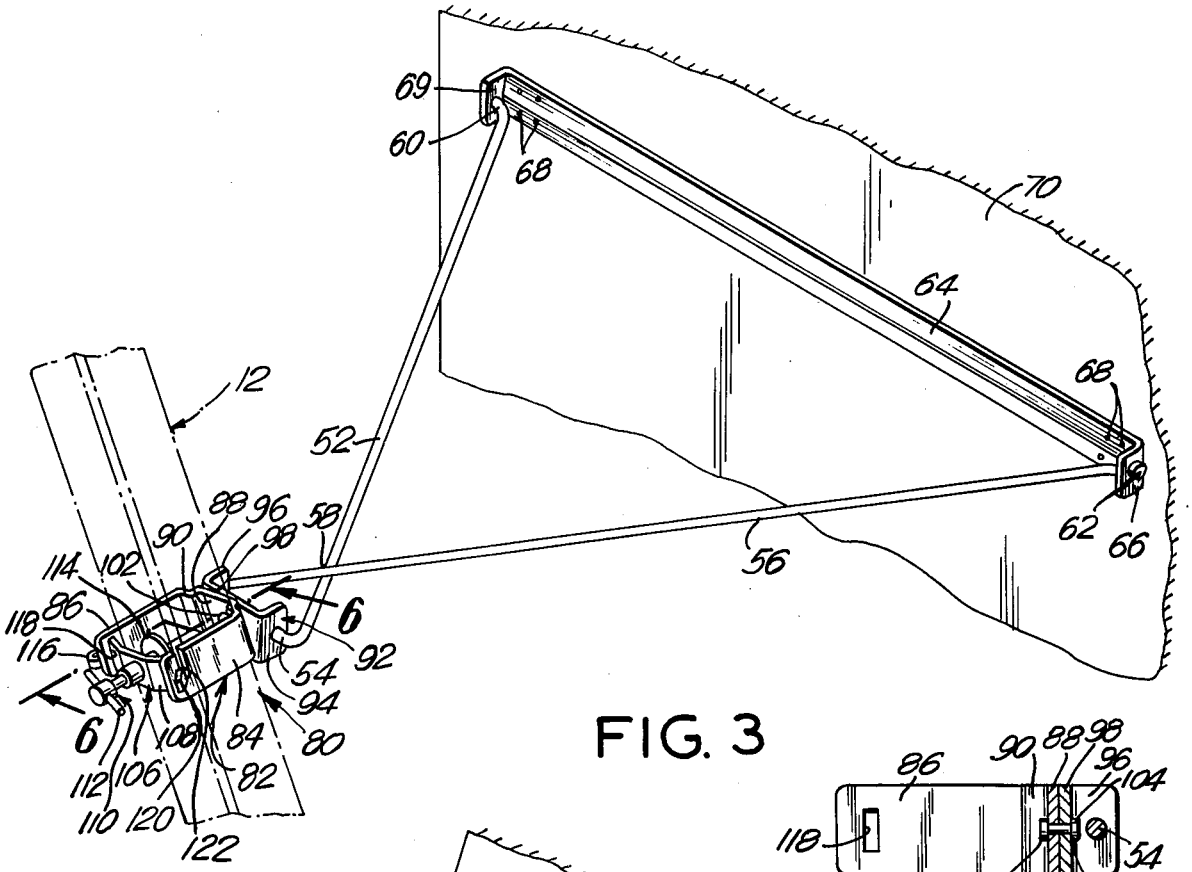
FIG. 3 is a perspective view of the brace showing the upright pole being vertically tilted about a horizontal axis so as to modify the vertical orientation of the pole with respect to the support surface.
Figure 6:
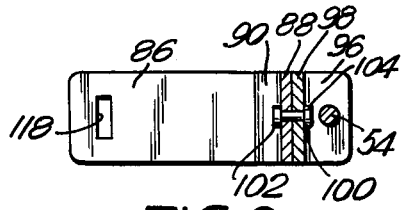
FIG. 6 is a cross sectional view through the center of the yoke assembly.
Figure 4:
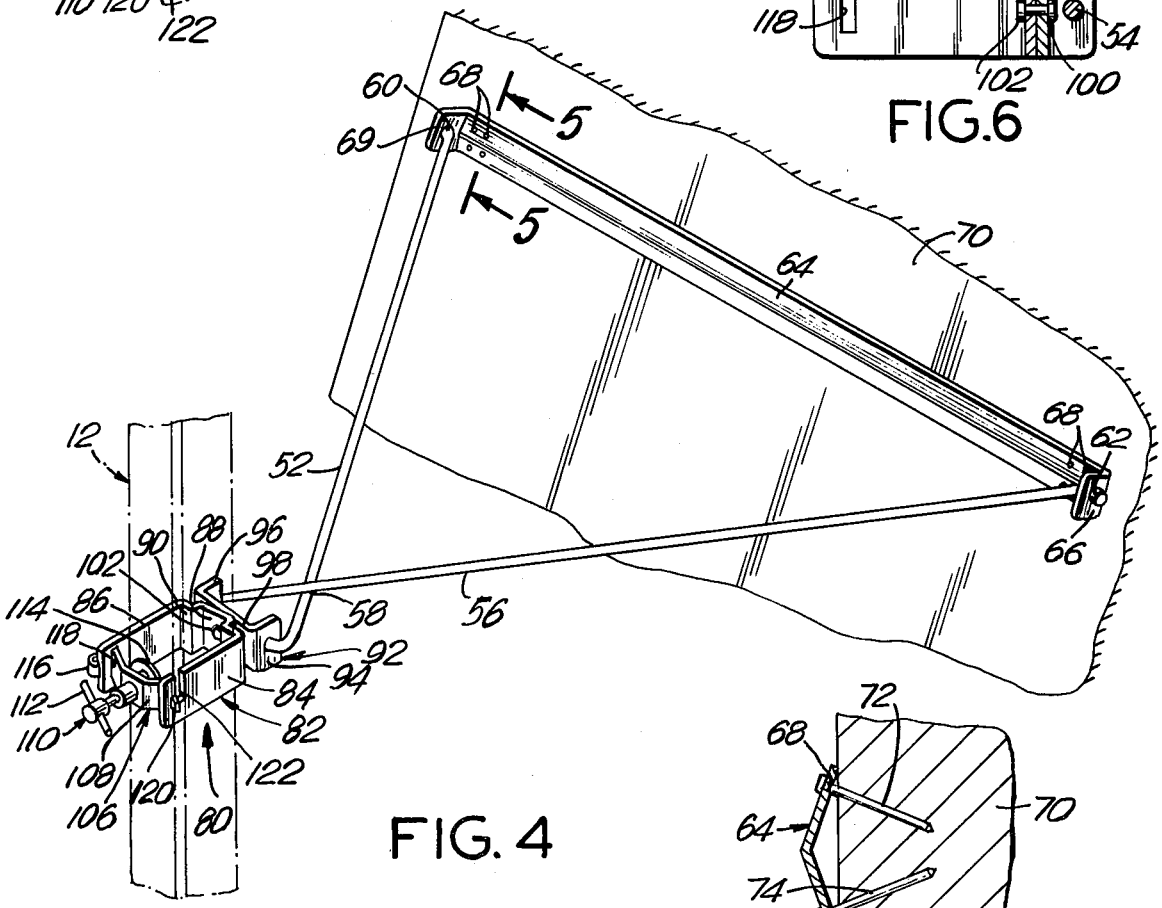
FIG. 4 is a perspective view similar to that shown in FIG. 3 and showing the brace holding the pole in a vertical direction while being connected to an angled support surface.

Referring now to FIGS. 2, 3 and 6, it will be noted that at the front end of the X-frame there is connected a yoke assembly shown generally at 80. The yoke assembly includes a front yoke member 82 formed of opposing legs 84, 86 interconnected by a bight portion 88. The bight portion itself includes a step section 94 increasing structure support. Facing rearwardly from the yoke 82, there is provided an additional yoke 92 including the opposing side legs 94, 96 interconnected by the bight portion 98. A rivet 100 passes through the center portion of the two bight portions 88, 98 and retains the two in rotational abutment by means of the opposing heads 102, 104.

The connecting rod 54 from the X-frame structure passes through apertures provided in the opposing legs 94, 96 of the yoke 92. The pole, on the other hand, passes through the yoke 82.

The pole itself is retained in place by means of a clamp 106. Typically, the clamp is of the type described in the aforementioned parent application.

More particularly, the clamp itself includes a plate member 108 which has a hole extending therethrough. A bolt 110 passes through the plate member and includes a wing nut 112 at one end thereof for manipulating the bolt and a bearing plate 114 at the opposing end for bearing against the pole 12.

A hook 116 extends from one end of the plate which fits into a slot 118 provided adjacent the distal end of one leg 86 of the yoke 82. At the other end of the plate 108 there is provided a tooth 120 which extends into an L-shaped slot 122 provided in the other leg 84 of yoke 82.

In operation, the brace is suitably connected to the pole by placing the pole 12 within the U-shaped yoke 82 and clamping it into place by tightening the wing nut 112 bearing the plate 114 against the pole. It should be appreciated, that the U-shaped yoke member 82 is designed out of one piece construction so that it securely holds the pole snugly and does not permit lateral play of the pole within the yoke. Furthermore, tightening of the clamp serves to press the poles against the bight portion and hold it in place.

It should be noted, that because of the offset formed in the bight portion 88 at the rear of the yoke 82, the head 102 of the rivet will not abut against the pole itself. On the other hand, the pole will abut against the side shoulders of the bight portion and be held securely in place. The head of the rivet will not damage the pole, and will not cause additional play of the pole. Accordingly, the pole is very tightly held within the yoke mechanism.

The clamp itself can be easily inserted by having the tooth slide into the L-shaped notch and held in place at the bottom thereof while it is clamped against the pole.

With the yoke tightly clamped onto the pole, the pole can be raised and suitably placed in position against the support surface. The connecting bar 64 is then placed against the support surface and suitable fastening members such as nails, screws, or the like, are inserted through the aperture 68 provided at opposing ends of the bar. It is noted, that four holes 68 are provided for this purpose adjacent either end to permit securely holding the bar 64 in place. Holes are not provided in the center of the bar in order to prevent nailing of the bar in an unstable manner.

As shown in FIG. 3, in order to permit raising of the pole, adjustment of the pole, etc., it is possible to vertically skew the pole with respect to the support surface. Thus, as shown in FIG. 3, with the bar placed against a vertical support surface, the pole 12 can be angled by rotating the pole about a horizontal axis which extends perpendicularly from the support surface. This vertical skewing of the pole is useful in utilizing pump jack poles.

Additionally, instead of skewing the poles with respect to the support surface, it is possible to maintain a pole vertically and utilize the present brace by rotating the brace about the same axis as shown in FIG. 3. In this manner, the connecting bar 64 can be placed along angled support surfaces that are skewed with respect to a vertical axis. In addition, because of the pivoting permitted between the bar 64 and the X-shaped frame construction, the support surface 70 can be of almost any orientation and yet the pole 12 can be maintained vertical.

It should also be appreciated that the entire yoke assembly can pivot about the connecting rod 54 which passes through the yoke 92. As a result, the yoke assembly and its pivotal connections permit various relative movements between the vertical pole and the support surface. For example, it permits modification of the relative vertical orientation of the pole with respect to the support surface by providing for relative rotation about two mutually perpendicular horizontal axes. One of these axes is along the connecting rod 54. The other horizontal axis would be perpendicular to the rod 54 and extending towards the support surface. Additionally, pivotal movement between the connecting bar 64 and the frame provides for additional modification of the orientation.

The particular pole that is demonstrated in the present invention is that shown in the aforedescribed parent application. Specifically, it includes an aluminum pole on which is placed a rubberized surface on one side thereof and is held in place by means of rivets. The present invention wherein the yoke 82 holds the pole has been found uniquely beneficial in securely holding such type of aluminum pole in place. Furthermore, the clamping member that is shown is also the one described in the aforementioned parent application. The particular combination of the clamping member, the aluminum pole, and the present brace has been found to be most uniquely suited to provide stability, safety, and easy operation.

There has been described heretofore the best embodiments of the invention presently contemplated. However, it is to be understood that various changes and modifications may be made thereto without departing from the spirit of the invention.

I claim:

1. A brace for securing a pole to a support surface, comprising:

a frame member for securement to the support surface;

a yoke assembly formed of a pair of U-shaped yoke members each having a respective pair of legs interconnected by a respective bight portion, one of said yoke members being coupled to said frame member and the other of said yoke members fitting around the pole;

swivel means comprising a pivot member coupling together said yoke members at their respective bight portions; said frame member comprising a pair of legs defining an X-shaped structure having one end wider than the other, and an integral connecting rod closing off the narrowed end of the structure to form a smaller and a larger triangle said connecting rod pivotally passing through the opposing legs of said one of said yoke members, whereby said yoke assembly and said frame member permit modification in the relative vertical orientation of the pole with respect to the support surface by providing for relative rotation about two mutually perpendicular horizontal axes, and wherein said swivel means lies along the center line of said X-shaped structure.

2. A brace as in claim 1, wherein each of said yoke members is formed of a respective unitary construction.

3. A brace as in claim 1, wherein the yoke member fitting around the pole has a bight portion comprising a pair of side shoulders interconnected by a recessed center span, said pivot member being coupled to the center span, the side shoulders abutting against a pole fitting into the yoke member, whereby the pivot is spaced from the pole to prevent rubbing against the pole.

4. A brace as in claim 1, wherein said frame member is formed of a one-piece construction.

5. A brace as in claim 1, and further comprising clamping means for closing off said other yoke member thereby securing the pole therewithin.

6. A brace as in claim 5, wherein an aperture is formed adjacent the distal end of one leg of said one yoke member and an opposing L-shaped slot is formed adjacent the distal end of the other leg, and wherein said clamping means comprises a hook at one side for engaging said aperture and a tooth at the opposing side for locking into said slot.

7. A brace as in claim 1, wherein said frame member further comprises a unitary bar spanning across the other end of said X-shaped rod construction.

8. A brace as in claim 7, wherein said unitary bar comprises end tabs transversely extending from said bar, the distal ends of said other end of said rod structure having bent feet portions, and an aperture in each of said tabs for respectively receiving said bent feet portions therein.

9. A brace as in claim 7, wherein said bar has a substantially V-shaped cross sectional configuration with its vertex extending away from the support surface.

10. A brace as in claim 9, and further comprising fastening holes formed in said bar whereby fastening means inserted therethrough will be angled into the support surface for secure retention.

* * * * *